US007701314B2

(12) United States Patent
Hazzard et al.

(10) Patent No.: US 7,701,314 B2
(45) Date of Patent: Apr. 20, 2010

(54) SOLENOID ASSEMBLY WITH OVER-MOLDED ELECTRONICS

(75) Inventors: Frederick R. Hazzard, Plymouth, MN (US); Nathan H. French, Prior Lake, MN (US); Christopher M. Lodermeier, Waverly, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/525,702

(22) Filed: Sep. 22, 2006

(65) Prior Publication Data

US 2008/0074219 A1 Mar. 27, 2008

(51) Int. Cl.
*H01F 7/00* (2006.01)

(52) U.S. Cl. ..... 335/278; 335/241; 335/260; 335/290; 335/292; 335/294

(58) Field of Classification Search ..... 335/241, 335/260, 278, 290, 292, 294, 303
See application file for complete search history.

(56) References Cited

U.S. PATENT DOCUMENTS 5,538,220 A 7/1996 LaMarca
5,703,551 A * 12/1997 Lefebvre et al. ..... 335/126
5,895,026 A * 4/1999 Linkner et al. ..... 251/129.15
6,049,263 A * 4/2000 Vilou ..... 335/126
6,120,114 A * 9/2000 Blazic et al. ..... 303/119.2
6,124,775 A 9/2000 Linkner, Jr.
6,164,323 A 12/2000 Smith et al.
6,352,317 B1 * 3/2002 Blazic et al. ..... 303/119.2
6,597,558 B1 * 7/2003 Luetzow et al. ..... 361/206
6,873,514 B2 12/2004 Maller et al.
6,969,924 B2 * 11/2005 Hisamoto ..... 290/38 R
7,026,243 B2 4/2006 Basceri
7,131,633 B2 * 11/2006 Delaney ..... 251/129.15
2003/0200761 A1 * 10/2003 Funahashi et al. ..... 62/228.4
2004/0197213 A1 * 10/2004 Takemoto ..... 417/410.1
2006/0186976 A1 * 8/2006 Kamidate et al. ..... 335/220
2007/0001527 A1 * 1/2007 Takahashi et al. ..... 310/71

* cited by examiner

*Primary Examiner*—Elvin G Enad
*Assistant Examiner*—Mohamad A Musleh
(74) *Attorney, Agent, or Firm*—Sonu N. Weaver

(57) ABSTRACT

A solenoid assembly (23) includes a coil assembly (65) having at least one coil winding (73) and an electronic circuit assembly (67), which is in electrical communication with the coil assembly (65). The electronic circuit assembly (67) has a printed circuit board (79) and at least one electronic component (81), which is surface mounted on the printed circuit board (79). A coating material (85) coats all of the plurality of external surfaces of the surface-mounted electronic component (81). A casing (87) over-molds an outer longitudinal surface (77) of the coil assembly (65) and all of a plurality of external surfaces of the electronic circuit assembly (67).

21 Claims, 5 Drawing Sheets

SOLENOID ASSEMBLY WITH OVER-MOLDED ELECTRONICS

BACKGROUND OF THE DISCLOSURE

1. Field of the Invention

The present invention relates to an electromagnetic solenoid assembly, and more particularly to the integration of an electronic circuit assembly in the electromagnetic solenoid assembly.

2. Description of the Related Art

Many off-highway vehicles, including but not limited to skid steer loaders, backhoe loaders, and mini-excavators, have a hydraulic system which includes one or more ancillary or auxiliary hydraulic functions to control some portion of the vehicle, such as raising and lowering a boom, or extending and retracting a boom. Many of these same vehicles require that the actuation of these hydraulic functions be electronic. Therefore, electromagnetic solenoid valve systems are often used on these vehicles to control those ancillary or auxiliary functions.

A typical electromagnetic solenoid valve system includes two primary components: an electromagnetic solenoid valve assembly and an electronic circuit assembly which electronically controls the electromagnetic solenoid valve assembly. In the typical electromagnetic solenoid valve system, the electronic circuit assembly can be mounted either remotely from the electromagnetic solenoid valve assembly or directly to the electromagnetic solenoid valve assembly.

In the remote mounting scenario, the electronic circuit assembly is typically mounted to the vehicle frame or to some rigid component of the vehicle. Since the electronic circuit assembly is in a remote location with respect to the electromagnetic solenoid valve assembly, a plurality of wires is used to allow for electrical communication between the electronic circuit assembly and the electromagnetic solenoid valve assembly. In addition, another plurality of wires is used to allow for communication between the electronic circuit assembly and a power source.

In the direct mounting scenario, the electronic circuit assembly is physically connected to the electromagnetic solenoid valve assembly. Typically, this physical connection is accomplished by using a bolt which fastens the electronic circuit assembly to the electromagnetic solenoid valve assembly and by mating a connector associated with the electronic circuit assembly to a connector associated with the electromagnetic solenoid valve assembly. In addition to assisting with the physical attachment of the electronic circuit assembly to the electromagnetic solenoid valve assembly, the connectors associated with the electronic circuit assembly and the electromagnetic solenoid valve assembly also establish the electrical communication between the electronic circuit assembly and the electromagnetic solenoid valve assembly. Similar to the remote mounted scenario, in the direct mounted scenario, a plurality of wires is used to allow for communication between the electronic circuit assembly and a power source.

While typical electromagnetic solenoid valve systems, such as the ones previously described, have proven to be successful commercially and to work well in many applications, such systems have some disadvantages when used in certain commercial applications. One such disadvantage associated with the systems previously described concerns the environmental protection of the electronic circuit assembly. As stated previously, these electromagnetic solenoid valve systems are used in vehicles such as skid steer loaders, backhoe loaders, and mini-excavators. As is well known to those skilled in the art, the environments in which these vehicles operate include water, dirt, mud, gravel, snow, and ice. In certain applications, the remote mounted and direct mounted electronic circuit assemblies may be particularly vulnerable to these environments due to the numerous locations on those electronic circuit assemblies through which such environmental hazards may ingress.

Another disadvantage associated with the systems previously described concerns the space requirements for use of such systems. A recent trend in commercial applications is to require that hydraulic components used on those applications, including the electromagnetic solenoid valve systems, be compact. In the direct mounted electronic circuit assembly scenario previously described, the electronic circuit assembly is typically directly mounted to the outer perimeter of the electromagnetic solenoid valve assembly, thereby increasing the overall outer perimeter of the electromagnetic solenoid valve system. As the overall outer perimeter of the electromagnetic solenoid valve system increase, the number of electromagnetic solenoid valve systems that can be mounted in a given sized manifold block decreases. Therefore, as the overall perimeter of the electromagnetic solenoid valve system increases, the size of the manifold block housing these systems must also increase. While the remote mounted electronic circuit board assembly does not result in an increase in the outer perimeter of the electromagnetic solenoid valve system, it does require additional space on the vehicle for remotely mounting the electronic circuit assembly.

BRIEF SUMMARY OF THE INVENTION

Accordingly, it is an object of the present invention to provide an electromagnetic solenoid assembly which overcomes the above discussed disadvantages of the prior art.

It is a further object of the present invention to provide an electromagnetic solenoid assembly that is compact.

It is a more specific object of the present invention to provide an electromagnetic solenoid assembly that is substantially protected from environmental hazards.

It is another object of the present invention to provide a method for making a solenoid assembly that overcomes the above discussed disadvantages of the prior art.

In order to accomplish the above mentioned objects, the present invention provides a solenoid assembly which includes a coil assembly, which has at least one coil winding and an outer longitudinal surface, an electronic circuit assembly, which has at least one electronic component, having a plurality of external surfaces, mounted to a circuit board, wherein the plurality of external surfaces of the electronic component are coated with a coating material, and a casing which over-molds the outer longitudinal surface of the coil assembly and all of the plurality of external surfaces of the electronic circuit assembly including the plurality of external surfaces of the electronic component.

In order to further accomplish the objects mentioned above, the present invention also provides a method for making a solenoid assembly that includes the steps of coating all the external surfaces of electrical components, which are included in an electronic circuit assembly, with a coating material. The surfaces of the electronic circuit assembly, including the plurality of external surfaces of the coated electronic component, and the outer longitudinal surface of the coil assembly are then over-molded with a casing material.

DETAILED DESCRIPTION OF THE PREFERRED EMBODIMENT

Although the present invention can be used in connection with various electromagnetic solenoids, including but not limited to automotive starter solenoids, proportional solenoids, and two-position solenoids, it is especially advantageous when used with electromagnetic solenoids which actuate a hydraulic valve. Therefore, the present invention will be discussed in connection with electromagnetic solenoid valves without intending to limit the scope of the invention.

Figure 1:
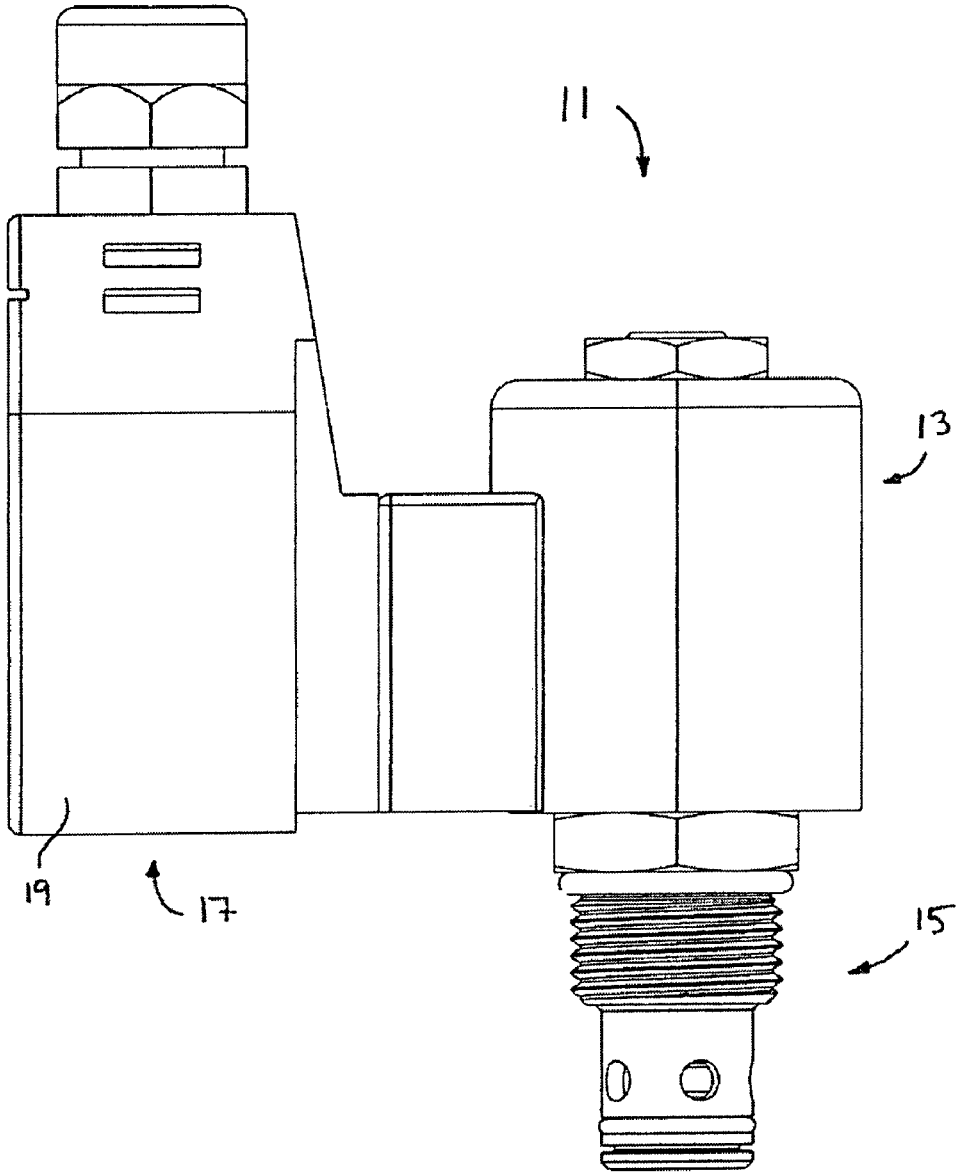
FIG. 1 PRIOR ART
FIG. 1 is a plain view of a prior art solenoid valve assembly.

Referring now to the drawings, which are not intended to limit the invention, FIG. 1 illustrates a plain view of a prior art solenoid valve assembly, generally designated 11. The prior art solenoid valve assembly 11 includes three primary component assemblies: a prior art solenoid assembly, generally designated 13, a valve assembly, generally designated 15, and a prior art electronic circuit assembly, generally designated 17. The prior art electronic circuit assembly 17 includes an outer housing 19 in which a circuit board assembly (not shown) is mounted with a plurality of mounting bolts (not shown). The prior art electronic circuit assembly 17 is attached to the prior art solenoid assembly 13 by a mounting bolt (not shown) and a plurality of connector pins (not shown), through which electrical communication is established between the prior art electronic circuit assembly 17 and the prior art solenoid assembly 13.

Figure 2:
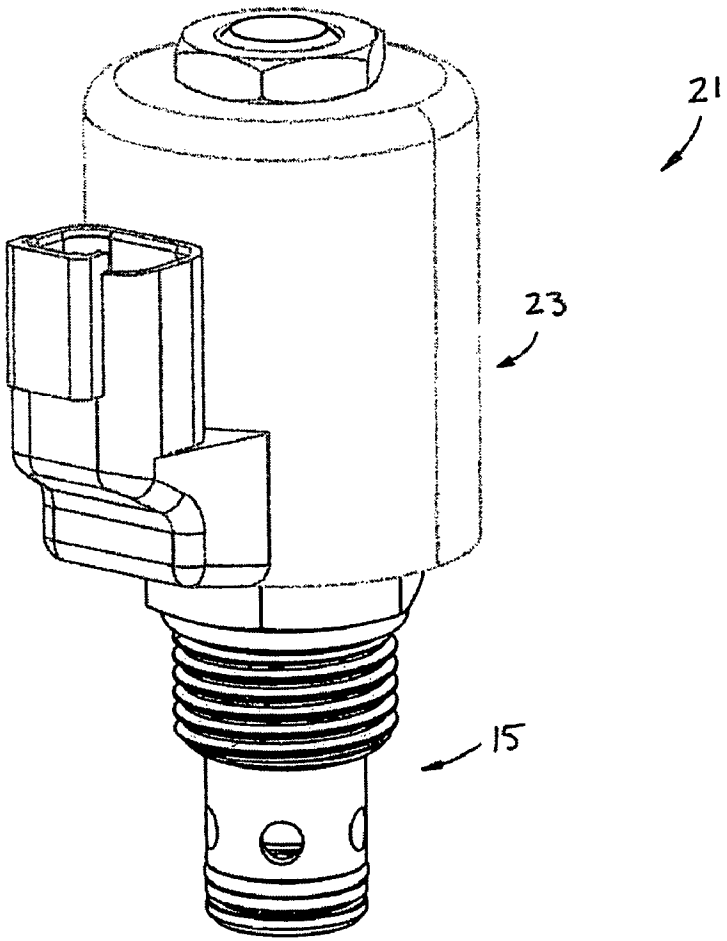
FIG. 2 is an isometric view of a solenoid valve assembly made in accordance with the present invention.

Referring now to FIG. 2, FIG. 2 illustrates an isometric view of a solenoid valve assembly, generally designated 21, made in accordance with the present invention. The solenoid valve assembly 21 includes two primary component assemblies: a solenoid assembly, generally designated 23, and the valve assembly 15.

Figure 3:
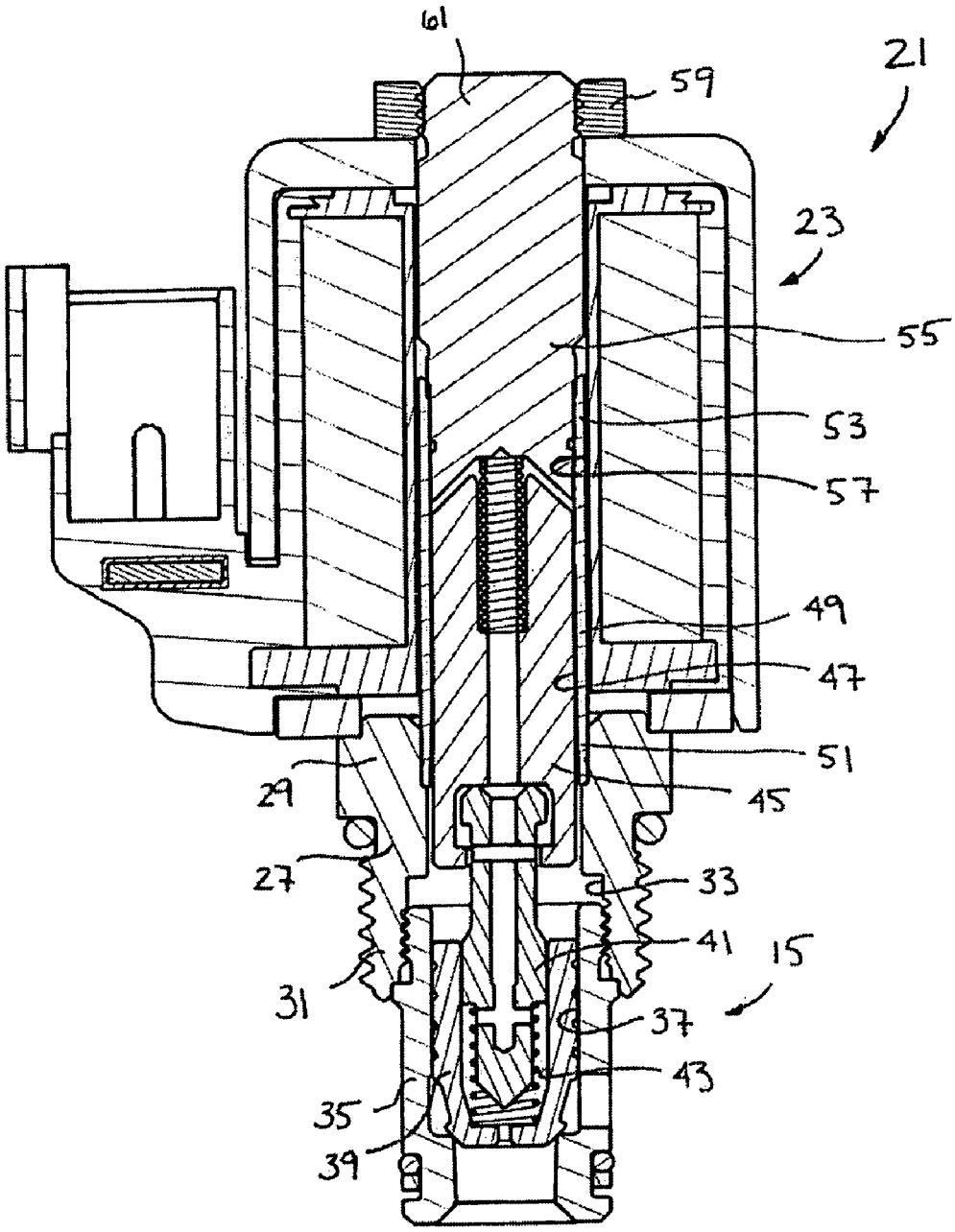
FIG. 3 is a cross-sectional view of a solenoid valve assembly made in accordance with the present invention.

Referring now to FIG. 3, an axial cross section of an embodiment of the solenoid valve assembly 21 is shown. The valve assembly 15 shown herein is a two-position, two-way valve. Since valve assemblies of this type are well known to those skilled in the art, the valve assembly 15 will only be described briefly herein.

The valve assembly 15 includes a valve retainer 27 having an upper portion 29 and a lower portion 31. The valve retainer 27 defines an axial bore 33, which extends through the upper and lower portions 29, 31, respectively, of the valve retainer 27. A valve cage 35 is in threaded engagement with the axial bore 33 in the lower portion 31 of the valve retainer 27. The valve cage 35 defines an axial bore 37 that extends through the length of the valve cage 35. A poppet member 39 is disposed in the axial bore 37 of the valve cage 35 for axial movement therein.

A pilot poppet 41 is disposed in an axial bore 43 defined by the poppet member 39. An armature 45, controlled by the solenoid assembly 23 which will be described in greater detail subsequently, actuates the pilot poppet 41. The armature 45 is disposed in an axial bore 47 of a non-magnetic sleeve 49, for axial movement therein. The non-magnetic sleeve 49 includes a first axial end portion 51 and a second axial end portion 53, with the outer diameter of the first axial end portion 51 being fixedly attached, such as through a brazing process, to the upper portion 29 of the valve retainer 27 and the inner diameter of the second axial end portion 53 being fixedly attached to an end plug 55. The non-magnetic sleeve 49 and the end plug 55 are disposed in an axial bore 57 defined by the solenoid assembly 23. The valve assembly 15 is secured to the solenoid assembly 23 by a nut 59, which is in threaded engagement with an axial end portion 61 of the end plug 55.

Figure 4:
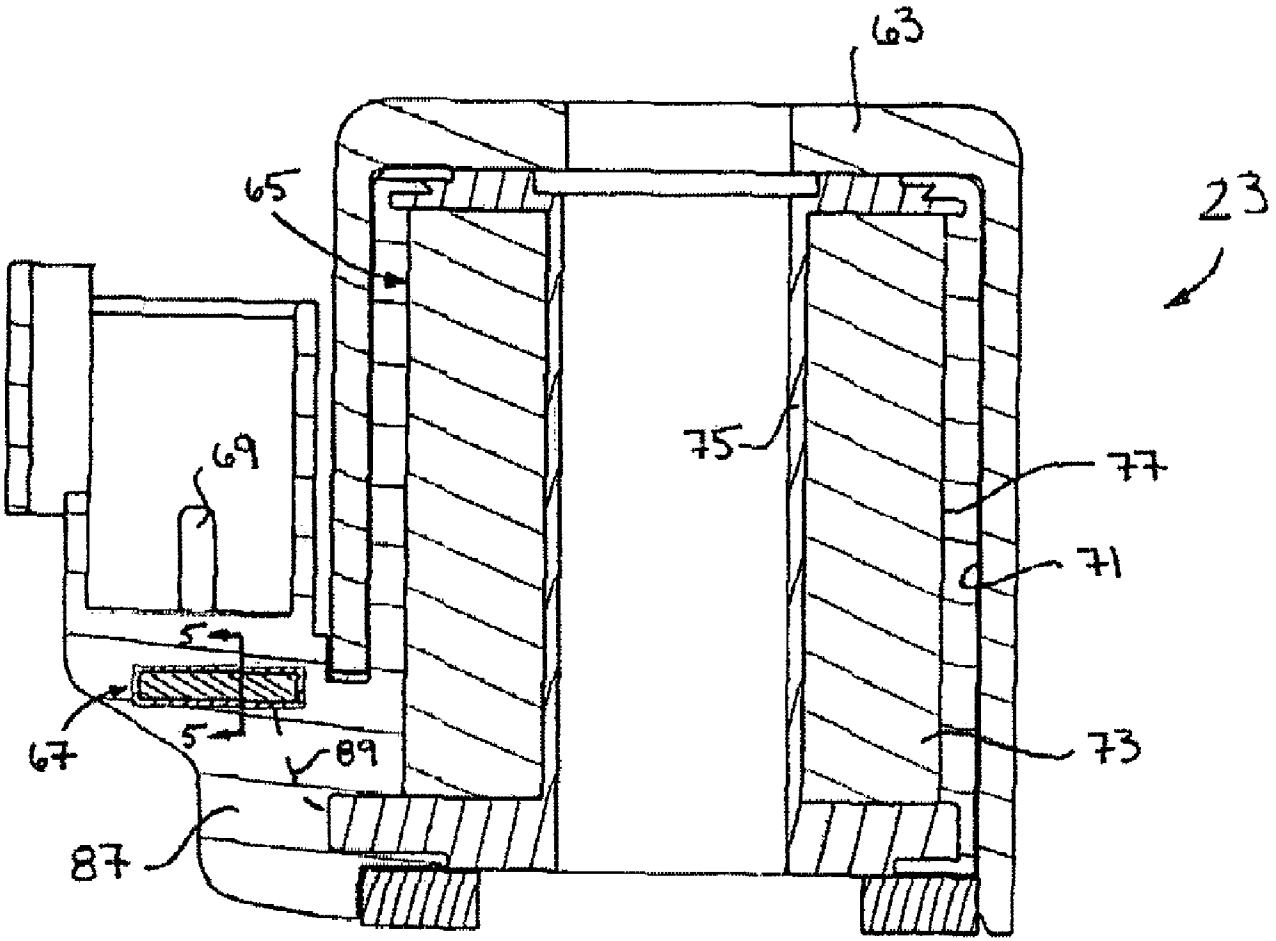
FIG. 4 is a cross-sectional view of a solenoid assembly made in accordance with the present invention.

Referring now to FIG. 4, the solenoid assembly 23 will be described in greater detail. The solenoid assembly 23 includes a ferromagnetic shell 63, a coil assembly, generally designated 65, an electronic circuit assembly, generally designated 67, which is in electrical communication with the coil assembly 65, and a set of external connector pins 69, which are in electrical communication with the electronic circuit assembly 67. In the present embodiment, the coil assembly 65 is disposed in an internal cavity 71 of the ferromagnetic shell 63.

The coil assembly 65 includes at least one coil winding 73 which is wrapped around a bobbin 75. It will be understood by those skilled in the art, however, that the bobbin 75 is not a critical element in the coil assembly 65. Since bobbinless coil assemblies have been disclosed in U.S. Pat. No. 6,124,775, entitled "Bobbinless Solenoid Coil," issued on Sep. 26, 2000, such coil assemblies will not be further described herein. For ease of discussion, however, the coil assembly 65 will be described with reference to the bobbin 75. The coil assembly 65 defines an outer longitudinal surface 77 which includes the outer longitudinal surface of the bobbin 75 and the outer longitudinal surface of the coil winding 73. While the coil assembly 65 has been shown in the subject embodiment to be cylindrical in shape, it will be understood by those skilled in the art that the scope of the present invention is not limited to the coil assembly 65 having a cylindrical shape.

Figure 5:
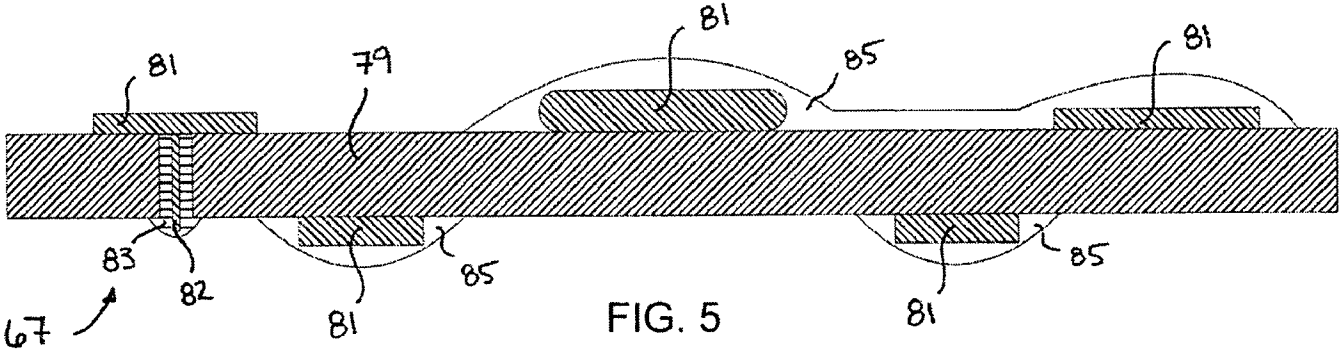
FIG. 5 is a cross-sectional view of an electronic circuit assembly taken on line 5-5 in FIG. 4.
Figure 6:
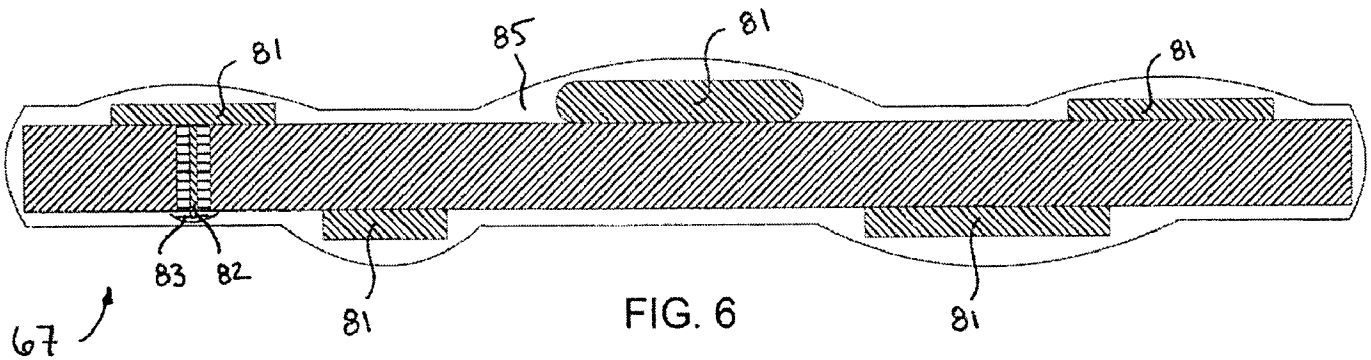
FIG. 6 is an alternate cross-sectional view of an electronic circuit assembly.

Referring now to FIGS. 5 and 6, the electronic circuit assembly 67 includes a printed circuit board 79 and a plurality of electronic components 81. The printed circuit board 79 is well known in the art and therefore will only be described briefly herein. Typically printed circuit boards 79 are made from a material such as, but not limited to, fiberglass. In order to establish electrical communication between the electronic components 81, a copper circuit pattern (not shown) is typically etched onto the printed circuit board 79. The electronic components 81 can be attached to the printed circuit board 79 through surface mounts or through-hole mounts. As is well known to those skilled in the art, through-hole mounts are zinc-plated holes that extend through the printed circuit board 79. After a lead 82 from the electronic component 81 is placed in the through-hole mount, solder is used to form a bond 83 between the lead 82 and the zinc-plated through-hole mount. In many instances, after the lead 82 is placed in the through-hole mount, a portion of the lead 82 that extends beyond the underside of the printed circuit board 79 is bent towards the printed circuit board 79 for further security against possible electrical disconnection. Surface mounts, on the other hand, are small zinc-plated pads located on the surface of the printed circuit board 79. After a lead (not shown) from the surface-mounted electronic component 81 is placed on the surface mount, solder is used to form a bond between the electronic component lead and the zinc-plated surface mount. While through-hole mounts are typically considered to be the most secure way of fastening the electronic component 81 to the printed circuit board 79 by those skilled in the art, surface mounts are preferred since they provide for a much more compact electronic circuit assembly 67 due to the larger sized printed circuit board 79 that is required for through-hole mounts.

Referring now primarily to FIG. 5, a coating material 85 is applied to the electronic circuit assembly 67 in order to protect the electrical connections between the surface-mounted electronic components 81 and the printed circuit board 79. In this embodiment, all of the external surfaces of the surface-mounted electronic components 81 are coated with the coating material 85, while portions of the printed circuit board 79 which do not contain surface-mounted electronic components 81 may or may not be coated. As used herein and in the appended claims, references to external surfaces of the surface-mounted electronic components shall mean those external surfaces of the surface-mounted electronic components 81 that are exposed after the electronic components 81 have been mounted to the printed circuit board 79.

FIG. 6 provides an alternate embodiment of the coated electronic circuit assembly 67. In this alternate embodiment, the coating material 85 provides a conformal coating over the entire electronic circuit assembly 67. While coating the entire electronic circuit assembly 67 may not be required, it may provide the most cost effective method of coating.

Referring still to FIGS. 5 and 6, an adhesive material, cyanoacrylate, was used as the coating material 85 to coat the electronic circuit assembly 67. However, since many different adhesive materials, epoxies, or potting compounds could be used to adequately protect the electrical connections between the surface-mounted electronic components 81 and the printed circuit board, it will be understood by those skilled in the art that the scope of the present invention is not limited to the use of cyanoacrylate as the coating material 85.

Referring again to FIG. 4, in order to protect the coil assembly 65 and the coated electronic circuit assembly 67 from environmental hazards, a casing 87 is molded over the outer longitudinal surface 77 of the coil assembly 65, and all of the surfaces of the coated electronic circuit assembly 67. It shall be understood that the phase "molded over" or the terms "over-mold," "over-molded," or "over-molding" as used herein and in the appended claims shall mean that all of the external surfaces of the coated electronic circuit assembly 67 are in contact with the casing material. In the subject embodiment, the casing 87 is a glass-filled nylon material. However, since many different plastic materials could be used to adequately over-mold the outer longitudinal surface 77 of the coil assembly 65 and the electronic circuit assembly 67, it will be understood by those skilled in the art that the scope of the present invention is not limited to use of a glass-filled nylon material. With all of the surfaces of the coated electronic circuit assembly 67 over-molded by the casing 87, the risk of damage to the electronic circuit assembly 67 caused by environmental hazards is significantly reduced. By over-molding all of the surfaces of the coated electronic circuit assembly 67, there is no path through which water, or some other environmental hazard, can harm the coated electronic circuit assembly 67. In addition to the decreased risk of damage to the coated electronic circuit assembly 67, incorporation of the coated electronic circuit assembly 67 into the coil assembly 65 through the over-molded casing 87 provides a much more compact design than the prior art embodiments previously discussed in the BACKGROUND OF THE INVENTION.

Another important aspect of the subject embodiment is the coating of the surface-mounted electronic components 81 with the coating material 85. If the coating material 85 is not applied to the surface-mounted electronic components 81 on the printed circuit board 79, the electronic circuit assembly 67 may become damaged during the over-molding process, which forms the casing 87. One way in which the non-coated electronic circuit assembly 67 may become damaged during the over-molding process is that the surface-mounted electronic components 81 may become electrically disconnected from the printed circuit board 79. During the over-molding process, the casing material is heated to a high temperature creating a viscous material. As this viscous casing material over-molds the electronic circuit assembly 67, the viscous forces of the casing material act against the electronic components 81. These viscous forces can cause the surface-mounted electronic components 81 to break away from the printed circuit board 79, thereby severing the electrical connection between the electronic components 81 and the printed circuit board 79. While in the preferred embodiment the entire electronic circuit assembly 67 would be coated with the coating material 85, the through-hole mounted electronic components 81 may not require this coating material 85 to remain in electrical contact with the printed circuit board 79 since the through-hole mounted electronic components 81 are inherently more secure than the surface-mounted electronic components 81. As a result, the through-hole mounted electronic components 81 may be able to withstand the viscous forces caused by the casing material during the over-molding process. Another way in which the electronic circuit assembly 67 may become damaged during the over-molding process is due to the temperature of the casing material. As previously stated, the casing material is heated to a high temperature during the over-molding process. This temperature has adverse effects on the electronic components 81 and in many situations results in permanent damage of the electronic components 81. The coating material 85, however, protects the electronic components 81 from the above-discussed damages, by acting as an insulator, which reduces the adverse temperature effects of the casing material on the electronic components 81 during the over-molding process.

A method for making the solenoid assembly 23 with the integrated electronic circuit assembly 67 will now be described. An electrical communication is established between the coil winding 73, which is wrapped around the bobbin 75, and a plurality of terminals 89 (shown only as a dotted line in FIG. 4). In the preferred embodiment, the terminals 89 are structurally rigid. An electrical communication is also established between the electronic circuit assembly 67, which includes the plurality of electronic components 81 that are mounted to the printed circuit board 79, and the terminals 89. In addition to the electrical communication with the terminals 89, the electronic circuit assembly 67 is also in electrical communication with the connector pins 69. With the electrical communications established between the electronic circuit assembly 67 and the terminals 89 and the connector pins 69, the surface-mounted electronic components 81 of the electronic circuit assembly 67 are then coated with the coating material 85. As previously discussed, in the preferred embodiment, a conformal coating would be applied to all of the surfaces of the electronic circuit assembly 67, although the scope of the present invention is not limited to a conformal coating. With the surface-mounted electronic components 81 of the electronic circuit assembly 67 coated, the coil assembly 65 and the connector pins 69 are then held in a tooling fixture, which is adapted for the over-molding process that forms the casing 87. Casing material is injection molded around the outer longitudinal surface 77 of the coil assembly 65 and all of the surfaces of the coated electronic circuit assembly 67. The casing material is then cooled forming the casing 87 which fully encapsulates the electronic circuit assembly 67 and the outer longitudinal surface 77 of the coil assembly 65.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A solenoid assembly comprising:

a coil assembly including at least one coil winding, wherein the coil assembly has an outer longitudinal surface;

an electronic circuit assembly in electrical communication with the coil assembly, wherein the electronic circuit assembly includes:

a printed circuit board;

at least one electronic component, which has a plurality of external surfaces and is surface mounted on the printed circuit board; and a coating material coating all of the plurality of external surfaces of the surface-mounted electronic component;

a casing over-molding the outer longitudinal surface of the coil assembly and all of a plurality of external surfaces of the electronic circuit assembly so that the outer longitudinal surface of the coil assembly and the plurality of external surfaces of the electronic circuit assembly are in direct contact with the casing.

2. A solenoid assembly as claimed in claim 1, further comprising a ferromagnetic shell having an internal cavity in which is disposed the casing.

3. A solenoid assembly as claimed in claim 1, further comprising a bobbin around which is wrapped the coil winding.

4. A solenoid assembly as claimed in claim 1, further comprising a plurality of connector pins being in electrical communication with the electronic circuit assembly.

5. A solenoid assembly as claimed in claim 4, wherein the casing over-molds a portion of said plurality of connector pins.

6. A solenoid assembly as claimed in claim 1, wherein the electronic circuit assembly includes at least one through-mounted electronic component.

7. A solenoid assembly as claimed in claim 1, wherein the coating material coats all the external surfaces of the electronic component.

8. A solenoid assembly as claimed in claim 7, wherein the coating material provides a conformal coating of all the external surfaces of the electronic component.

9. A solenoid assembly as claimed in claim 1, wherein the coating material is a cyanoacrylate.

10. A solenoid assembly as claimed in claim 1, wherein the casing is of a glass-filled nylon material.

11. A method of making a solenoid assembly comprising the steps of:

coating all external surfaces of surface-mounted electronic components, which are included in an electronic circuit assembly and surface mounted to a printed circuit board, with a coating material; and over-molding all surfaces of the electronic circuit assembly and an outer longitudinal surface of a coil assembly with a casing material, wherein the outer longitudinal surface of the coil assembly and all of the surfaces of the electronic circuit assembly are in direct contact with the casing material.

12. A method of making a solenoid assembly as claimed in claim 11, further comprising the step of establishing electrical communication between the electronic circuit assembly and a plurality of terminals.

13. A method of making a solenoid assembly as claimed in claim 12, wherein the plurality of terminals are structurally rigid.

14. A method of making a solenoid assembly as claimed in claim 11, further comprising the step of establishing electrical communication between the electronic component and a plurality of connector pins.

15. A method of making a solenoid assembly as claimed in claim 14, wherein said casing material over-molds a portion of said connector pins.

16. A method of making a solenoid assembly as claimed in claim 11, wherein all external surfaces of the electronic components and the printed circuit board are coated with the coating material.

17. A method of making a solenoid assembly as claimed in claim 16, wherein the coating material is a conformal coating.

18. A method of making a solenoid assembly as claimed in claim 11, wherein the coating material is cyanoacrylate.

19. A method of making a solenoid assembly as claimed in claim 11, wherein the material of the casing is glass-filled nylon.

20. A solenoid valve assembly comprising:

a valve assembly;

a solenoid assembly engaged to the valve assembly, the solenoid assembly having:

a coil assembly including at least one coil winding, wherein the coil assembly has an outer longitudinal surface; an electronic circuit assembly in electrical communication with the coil assembly, wherein the electronic circuit assembly includes: a printed circuit board; at least one electronic component, which has a plurality of external surfaces and is surface mounted on the printed circuit board; and a coating material coating all of the plurality of external surfaces of the surface-mounted electronic component; a casing over-molding the outer longitudinal surface of the coil assembly and all of a plurality of external surfaces of the electronic circuit assembly so that the outer longitudinal surface of the coil assembly and the plurality of external surfaces of the electronic circuit assembly are in direct contact with the casing.

21. A solenoid valve assembly as claimed in claim 20, wherein the coating material of the electronic circuit assembly coats a plurality of external surfaces of the printed circuit board.

* * * * *